US012667133B2

(12) United States Patent
Wen et al.

(10) Patent No.: US 12,667,133 B2
(45) Date of Patent: Jun. 30, 2026

(54) ENVIRONMENT-FRIENDLY WRAPPING-FREE HEAT-NOT-BURN NAKED TOBACCO PRODUCT

(71) Applicant: NEW FLAME INTELLIGENT MANUFACTURING (SHENZHEN) CO., LTD., Shenzhen (CN)

(72) Inventors: Yuqing Wen, Shenzhen (CN); Zhiyong Wen, Shenzhen (CN); Huajun Yuan, Shenzhen (CN); Xu Zhao, Shenzhen (CN)

(73) Assignee: NEW FLAME INTELLIGENT MANUFACTURING (SHENZHEN) CO., LTD., Shenzhen (CN)

( * ) Notice: Subject to any disclaimer, the term of this patent is extended or adjusted under 35 U.S.C. 154(b) by 315 days.

(21) Appl. No.: 18/036,353

(22) PCT Filed: Nov. 26, 2021

(86) PCT No.: PCT/CN2021/133481
§ 371 (c)(1),
(2) Date: May 10, 2023

(87) PCT Pub. No.: WO2022/116903
PCT Pub. Date: Jun. 9, 2022

(65) Prior Publication Data

US 2023/0404135 A1 Dec. 21, 2023

(30) Foreign Application Priority Data

Dec. 4, 2020 (CN) ..... 202011415425.0

(51) Int. Cl.
*A24B 15/16* (2020.01)
*A24B 15/14* (2006.01)
(Continued)

(52) U.S. Cl.
CPC ..... *A24D 1/20* (2020.01); *A24B 15/14* (2013.01); *A24B 15/26* (2013.01); *A24B 15/302* (2013.01);
(Continued)

(58) Field of Classification Search
CPC ..... A24D 1/20
See application file for complete search history.

(56) References Cited

U.S. PATENT DOCUMENTS

2006/0196517 A1 9/2006 Gedevanishvili et al.
2012/0291793 A1* 11/2012 Byrd ..... A24D 3/14 526/89
(Continued)

FOREIGN PATENT DOCUMENTS

CN 101088426 A 12/2007
CN 109363230 A * 2/2019 ..... A24B 15/16
(Continued)

OTHER PUBLICATIONS

English Machine Translation of CN 110477438 A, obtained from PE2E Search (Clarivate Analytics) (Year: 2019).*
(Continued)

*Primary Examiner* — Philip Y Louie
*Assistant Examiner* — Charlotte Davison

(57) ABSTRACT

The present disclosure provides an environment-friendly wrapping-free heat-not-burn naked tobacco product. The tobacco product includes, in percentage by mass, 20-60% of mixed powder, 10-40% of a porous carrier material, 15-50% of a tobacco extraction mixture, 1-10% of a particle aggregation inhibitor and 10-40% of a binder. The environment-friendly wrapping-free heat-not-burn naked tobacco product can effectively inhibit emission of harmful substances in smoke; meanwhile, a paper tube, a filter tip and a blocking piece which are required for a traditional cigarette are not
(Continued)

needed, the naked tobacco product is utilized, the difficulty of a production process is lowered, raw materials are reduced, and the tobacco product is more environmentally friendly. According to the tobacco product with the proportion of components, the smoke amount is abundant, the fragrance is good, smoke is soft and fine, offensive firewood smell is avoided, irritation is small, the remaining taste makes people comfortable.

11 Claims, 2 Drawing Sheets

(51) Int. Cl.

| | |
|---|---|
| ***A24B 15/26*** | (2006.01) |
| ***A24B 15/30*** | (2006.01) |
| ***A24B 15/32*** | (2006.01) |
| ***A24B 15/38*** | (2006.01) |
| ***A24B 15/42*** | (2006.01) |
| ***A24D 1/00*** | (2020.01) |
| ***A24D 1/20*** | (2020.01) |

(52) U.S. Cl.
CPC ..... *A24B 15/32* (2013.01); *A24B 15/385* (2013.01); *A24B 15/42* (2013.01); *A24D 1/002* (2013.01)

(56) References Cited

U.S. PATENT DOCUMENTS

| | | | | |
|---|---|---|---|---|
| 2019/0264385 | A1* | 8/2019 | Pauwels | D01F 2/00 |
| 2021/0401030 | A1* | 12/2021 | Chen | A24C 5/01 |

FOREIGN PATENT DOCUMENTS

| | | | | | |
|---|---|---|---|---|---|
| CN | 110477438 | A | * 11/2019 | ..... | A24B 15/16 |
| CN | 112471590 | A | 3/2021 | | |
| KR | 20160069064 | A | 6/2016 | | |
| WO | WO-2019048880 | A1 | * 3/2019 | ..... | A61M 15/06 |

OTHER PUBLICATIONS

English Machine Translation of CN 109363230, obtained from PE2E Search (Clarivate Analytics) (Year: 2019).*
International Search Report of PCT/CN2021/133481.
Written Opinion of PCT/CN2021/133481.

* cited by examiner

ENVIRONMENT-FRIENDLY WRAPPING-FREE HEAT-NOT-BURN NAKED TOBACCO PRODUCT

CROSS REFERENCE TO RELATED APPLICATIONS

The present application is a national stage application of PCT/CN2021/133481 This application claims priorities from PCT Application No. PCT/CN2021/133481, filed Nov. 26, 2021, and from Chinese application No. 2020114154250 filed Dec. 4, 2020, the content of which are incorporated herein in the entirety by reference.

TECHNICAL FIELD

The present disclosure relates to the technical field of tobacco products, in particular to an environment-friendly wrapping-free heat-not-burn naked tobacco product.

BACKGROUND

Smoking is becoming a common consensus of people as harmful to health, and a great deal of research proves that after a cigarette is ignited, various substances harmful to human bodies such as aldehydes, nitrides, olefins and nicotine can be generated. Therefore, development of a novel tobacco product capable of greatly reducing the release amount of harmful ingredients in tobacco gradually becomes the key point of the tobacco industry of all countries in the world. At present, a plurality of types of non-burning smoking tobacco have been provided in the market, and tobacco shreds are heated and baked at a lower temperature by means of a heating smoking set to generate smoke, so that aroma ingredients in the tobacco shreds are volatilized, and a process of smoking cigarettes is achieved.

There have been some studies in the prior art to a heat-not-burn naked tobacco product. CN110101128A relates to a heat-not-burn tobacco, including a filter section and a heating section which are connected to form an integrated structure; the filter section is a fiber filter rod; the heating section includes a tobacco part and a cigarette paper layer on the outer layer; the tobacco part is composed of a load matrix and tobacco microcapsules; and the load matrix has a round-tube-shaped structure, and the tobacco microcapsules are adsorbed into the load matrix or arranged in a cavity in a side wall of the load matrix. By arranging the heating section part of a heat-not-burn cigarette into a part with the load matrix and the load microcapsules, microcapsules loaded with a tobacco extract or other characteristic substances and a smoke-producing agent are loaded to the load matrix, compared with a traditional finished product heating section which is prepared by coating a tobacco extract, an adhesive and other characteristic auxiliary materials at high proportion, the heating section part of the heat-not-burn cigarette has the characteristics that the moisture content of the heating section part may be reduced obviously, loss of the tobacco extract and other characteristic substances and oxidative deterioration caused by the fact that the tobacco extract and the other characteristic substances are in contact with air are avoided, dipping to cigarette paper is also avoided, the quality stability of the smoke during initial smoking of a consumer is improved, and the sensory effect is improved. CN111329121A discloses a heat-not-burn cigarette, including a fixing member, a heat-not-burn cigarette main body, a tobacco sheet section and a rolling member, wherein the fixing member is provided with a butt-joint end, the heat-not-burn cigarette main body is mounted on the fixing member, the tobacco sheet section is mounted at the butt-joint end of the fixing member, the fixing member, the heat-not-burn main body and the tobacco sheet section are wrapped into the rolling piece, and the rolling piece is implemented to be made from a breathable sheet material. CN111418904A provides a heat-not-burn tobacco product, which is composed of a heat-not-burn tobacco regenerated material and an encapsulation shell. The encapsulation shell includes a tobacco product cup and a tobacco product cover, the tobacco product cup includes a tobacco product cup opening end face, a tobacco product cup side wall face and a tobacco product cup bottom end face, and the tobacco product cup is provided with an air flow inlet. The tobacco product cover includes a tobacco product cover top end face and a tobacco product cover side wall face, and a smoke flow-out hole is formed in the tobacco product cover top end face. The tobacco product cover is fixed in the tobacco product cup in an embedded manner by matching with the tobacco product cup opening end face in a clamped manner. By utilizing the structure, adverse chemical reaction generated by heating and gluing and the like and adverse effects to tobacco contents are avoided, use of accessories such as a sealing pad is avoided, the production cost is greatly reduced, and the processing efficiency is effectively improved.

An existing heat-not-burn tobacco product has some defects, smoke formed during smoking is obvious, and the smoke is easy to volatilize to influence the surrounding environment; meanwhile, complex working procedures of a preparation method and high cost are not favorable for commercial application, for example, the preparation process of the tobacco product is complex, the structure of the tobacco product is complex, each structural component in the tobacco product contains non-degradable materials (such as a filter tip rod and a blocking piece) which are harmful to the environment, and the components in the tobacco product can volatilize certain harmful substances after being heated at a high temperature and are easily absorbed into the body. In addition, the tobacco products/cigarettes consume a large amount of paper tubes or tipping paper for wrapping, the production cost is high, and a large amount of natural resources such as wood are required to be consumed.

SUMMARY

The inventor has found that when smoking a tobacco product, a particulate form in which some chemical substances (including products formed by chemical reactions of organic or inorganic substances at high temperature) aggregate is produced during heating of tobacco, for example, the particles are typically in the form of an aerosol containing harmful and active group particles such as $NH^{4+}$, $CO_x$, $SO_x$, $NO_x$, nitrosamines, nitrogen heterocycles, cyclic ketones, quinones, phenols and acids, and typically have a particle size not exceeding 10 μm. When approaching one another, these harmful particles are likely to aggregate to form aggregates, and the aggregates are mixed with smoke and volatilized with the smoke. The volatilized smoke can be directly inhaled into the body by consumers and other organisms in the same environment, and is harmful to health; and meanwhile, the smoke particles can absorb other water-soluble particles generated in the environment, such as sulfate, nitrate, ammonium salt, volatile organic compounds (VOC), polycyclic aromatic hydrocarbon and toxic substances, and further damage the health of consumers and the environment is aggravated. In addition, smoke mixed with these harmful group particles also produces a nauseating and irritating odor, and makes people uncomfortable.

The inventor has made a solution to the above problems by adding an inhibitor for regulating aggregation of the active group particles into the tobacco product of the present disclosure, the inhibitor coats the surfaces of organic group particles when the tobacco product is heated, and captures radicals of those active particles (such as $OH^-$, $H^+$ and condensed aromatic hydrocarbons), and the captured surface radicals are deactivated, thereby preventing harmful particles from agglomerating and being mixed in smoke and volatilized together with the smoke. Preferably, the inhibitor is selected to be an alkylated ester with polar groups, such as one or a combination of glycerol triacrylate, glycerol trimethacrylate and pentaerythritol tetraacrylate. The tobacco product added with the inhibitor can well show the effect of naked tobaccos. The inhibitors are selected to be capable of combining with free radicals on the surfaces of active particles well, and are diffused, adsorbed and wrapped on the surfaces of the active particles before the inhibitors are aggregated to become smoke to be volatilized, and polar groups contained in the inhibitors cut the aggregated active particles or active particles about to be aggregated into monodisperse particles due to repulsion.

Specifically, in a first aspect of the present disclosure, an environment-friendly wrapping-free heat-not-burn naked tobacco product is provided.

In an embodiment, the environment-friendly wrapping-free heat-not-burn naked tobacco product, including: 20-60% of mixed powder, 10-40% of a porous carrier material, 15-50% of a tobacco extraction mixture, 1-10% of a particle aggregation inhibitor and 10-40% of a binder in percentage by mass; wherein the mixed powder, the porous carrier material, the tobacco extraction mixture, the particle aggregation inhibitor and the binder are mixed in percentage by mass to prepare a stereoscopic porous naked tobacco product.

In a second aspect of the present disclosure, a preparation process for an environment-friendly wrapping-free heat-not-burn naked tobacco product is provided, and the preparation process includes composition and preparation steps of the environment-friendly wrapping-free heat-not-burn naked tobacco product.

In an embodiment, the preparation process includes the following steps:

step S100, preparing mixed power, specifically, selecting tobacco leaves, tobacco stems and scented plants according to a set mass ratio of components, and grinding, pulverizing and mixing the tobacco leaves, the tobacco stems and the scanted plants to obtain the mixed powder;

step S200, preparing a tobacco extraction mixture, specifically, mixing and stirring a tobacco extract and a food-grade alcohol solvent according to a set mass ratio of components to obtain the tobacco extraction mixture; and step S300, carrying out mixing and stirring, specifically, adding the tobacco extraction mixture and a porous carrier material into the mixed power to be mixed and stirred uniformly to obtain a stirred mixture;

step S400, forming a naked tobacco product, specifically, adding a particle aggregation inhibitor and a binder into the stirred mixture, carrying out stirring fully, and extruding the stirred product by means of an extruding machine to form a stereoscopic porous naked tobacco product; and step S500, carrying out drying treatment, specifically, carrying out drying treatment on the formed stereoscopic porous naked tobacco product to obtain the environment-friendly wrapping-free heat-not-burn naked tobacco product.

After the tobacco leaves, the tobacco stems and the scented plants are pulverized, a step of sieving the pulverized product by a 80-mesh sieve is carried out further.

Preparing the tobacco extract includes the following steps:

step S201, pulverizing tobacco to obtain tobacco powder;

step S202, heating, refluxing and extracting the tobacco powder to obtain an extract; and step S203, carrying out fractional distillation on the extract via a molecular distillation apparatus to obtain the tobacco extract. The extruded stereoscopic porous naked tobacco product is cylindrical, rhombic, polygonal or spherical, and when the stereoscopic porous naked tobacco product is cylindrical, the stereoscopic porous naked tobacco product has the diameter of 1-10 mm and the height of 1-45 mm. In other embodiments, the tobacco product is optional in shape and also optional in size, and the shape and size of the tobacco product can be selected according to demands of users.

In an embodiment, in the drying treatment step, the water content in the dried environment-friendly wrapping-free heat-not-burn naked tobacco product is 5-30%.

In an embodiment, in the drying treatment step, the drying temperature does not exceed 60° C., and the drying time does not exceed 2 h.

In a third aspect of the present disclosure, application of the environment-friendly wrapping-free heat-not-burn naked tobacco product in an electronic cigarette is provided.

According to any one of the preceding aspects, the mixed powder includes: 10-30% of tobacco leaves, 10-40% of tobacco stems and 20-60% of scented plants in percentage by mass. The tobacco leaves include: at least one of tobacco leaf upper portion powder, tobacco leaf middle portion powder and tobacco leaf lower portion powder. The scented plants include at least one of moxa stems, *Citrus aurantium* L. var. *amara* Engl., stems of notoginseng flowers, tea leaves, flos lonicerae, herba taraxaci, folium menthae, folium nelumbinis, coconut shells, flos plumeriae acutifoliae, herba mesonae chinensis, herb gynostemmae pentaphylli, herba laggerae, maca, antrodia camphorata, tea stems and fruit of solanaceous plants.

According to any one of the preceding aspects, the tobacco extraction mixture includes: 10%-50% of a tobacco extract and 50%-90% of a food-grade alcohol solvent in percentage by mass.

According to any one of the preceding aspects, the food-grade alcohol solvent includes: 1-20% of edible alcohol, 10-60% of glycerol and 1-60% of propylene glycol in percentage by mass.

According to any one of the preceding aspects, the concentration of the edible alcohol is 75 wt %.

According to any one of the preceding aspects, the particle aggregation inhibitor includes: one or a combination of glycerol triacrylate, glycerol trimethacrylate and pentaerythritol tetraacrylate.

According to any one of the preceding aspects, the binder is at least one of polyvinylpyrrolidone, vinyl pyrrolidone-vinyl acetate copolymer, dextrin, starch, methyl cellulose, ethyl cellulose, CMC, CMCNa, guar gum, xanthan gum and HPMC.

According to any one of the preceding aspects, the porous carrier material is an inorganic porous carrier material, and the inorganic porous carrier material is at least one of a molecular sieve, zeolite powder, macroporous resin, porous ceramic powder, alumina powder, coral powder, porous silica gel, oak powder, foamed nickel, foamed aluminum, porous stainless steel, porous silicon carbide and foamed glass.

According to any one of the preceding aspects, the porous carrier material is an organic porous carrier material, and the organic porous carrier material is at least one of expanded tobacco stem powder, flower stem powder, radix puerariae powder, coffee powder and folium menthae powder.

The environment-friendly wrapping-free heat-not-burn naked tobacco product provided by the present disclosure contains a particle aggregation inhibitor ingredient, aggregation of harmful particles during heating of the tobacco product is effectively stopped, the circumstance that aggregated particles are volatilized along with smoke is restrained, and odor and solid pollution sources are removed; and meanwhile, the tobacco product does not need a paper tube, a filter tip and a blocking piece which are required for a traditional cigarette, a naked tobacco product is utilized, thus, the difficulty of a production process is reduced, raw materials are reduced, and the naked tobacco product is more environment-friendly. According to the naked tobacco product with the proportion of components, the smoke amount is abundant, the fragrance is good, smoke is soft and fine, offensive firewood smell is avoided, irritation is small, the remaining taste makes people comfortable, and the user experience is better.

Meanwhile, the tobacco product in the present disclosure does not need a paper tube, a filter tip and a blocking piece which are required for a traditional cigarette, a naked tobacco product is utilized, thus, the difficulty of a production process is reduced, raw materials are reduced, and the naked tobacco product is more environment-friendly. According to the naked tobacco product with the proportion of components, the smoke amount is abundant, the fragrance is good, smoke is soft and fine, offensive firewood smell is avoided, irritation is small, the remaining taste makes people comfortable, and the user experience is better.

The present disclosure aims to overcome shortages in the prior art, and provides an environment-friendly wrapping-free heat-not-burn naked tobacco product so as to solve the technical problems that an existing tobacco product has obvious harmful substances in smoke, is complex in structure and high in cost, and environmental protection is easily caused.

DETAILED DESCRIPTION OF THE EMBODIMENTS

Figure 1:
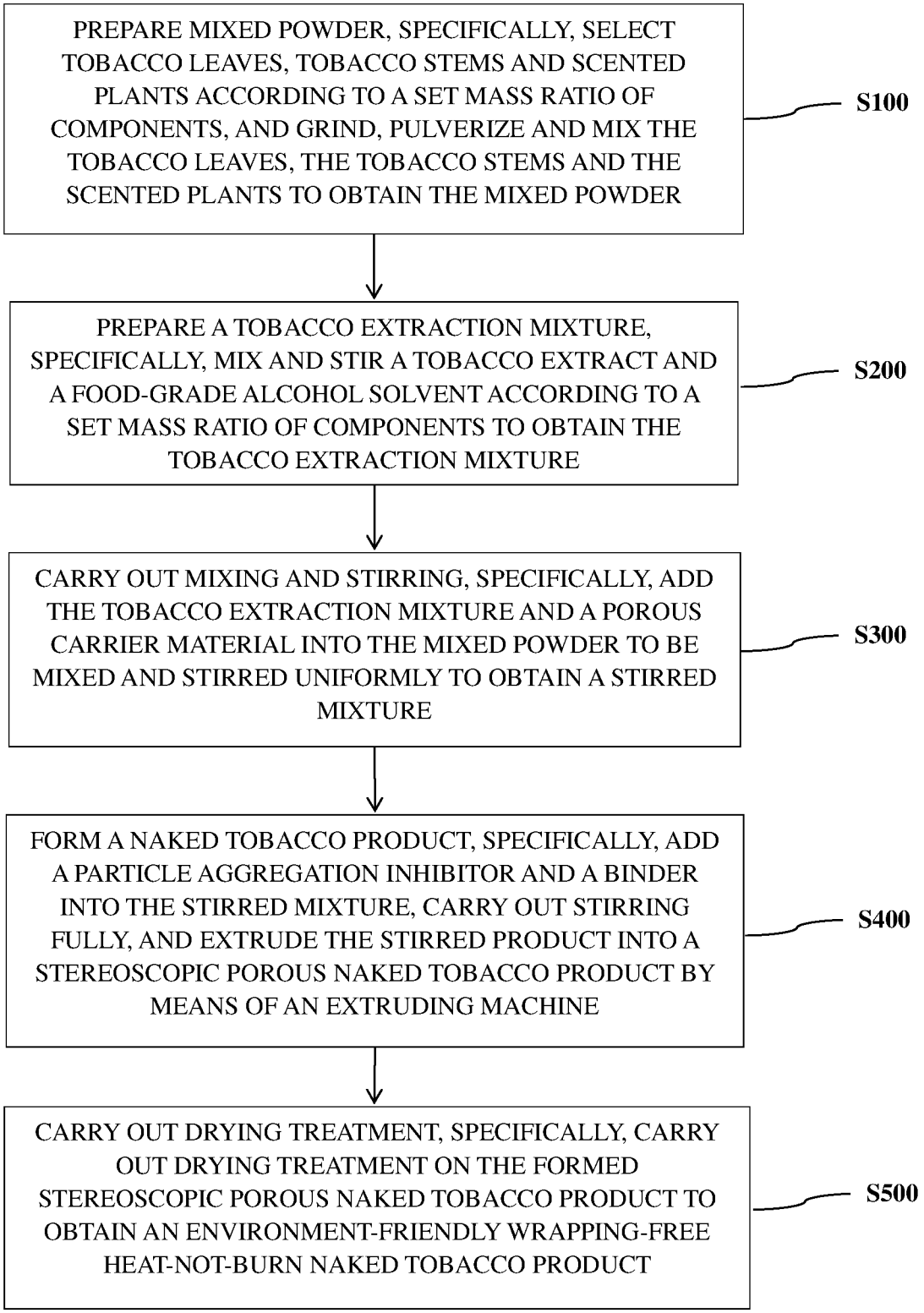
FIG. 1 is a main flow chart of a preparation method for an environment-friendly wrapping-free heat-not-burn naked tobacco product according to the present disclosure.

In order to make the objectives, technical solutions and advantages of the present disclosure more apparent, the present disclosure will be described in detail with reference to the accompanying drawings and the specific implementation modes below.

The technical solutions in the embodiments of the present disclosure will be clearly and completely described below with reference to the drawings in the embodiments of the present disclosure, and it is obvious that the described embodiments are only a part of the embodiments of the present disclosure, and not all of the embodiments. All other embodiments, which can be obtained by a person skilled in the art without creative effort based on the embodiments of the present disclosure, are within the scope of protection of the present disclosure.

In the description of the present disclosure, unless otherwise explicitly specified or limited, the terms "mounted", "linked", "connected", "fixed" and the like are to be construed broadly, for example, as either connected or detachably connected, or integral; the connection can be mechanical connection or electrical connection; and the connection can be direct connection, can also be indirect connection through an intermediate medium, and can be communication of interiors of two elements or interaction relationship of the two elements. The specific meanings of the above terms in the present disclosure can be understood according to specific situations by those of ordinary skill in the art.

In the description of the present disclosure, unless otherwise explicitly specified or limited, the recitation of a first feature is "on" or "under" a second feature may include the recitation that the first and second features are in direct contact, and may also include the recitation that the first and second features are not in direct contact, but are in contact via another feature between them. Also, the recitation that the first feature is "on," "above" and "over" the second feature may include the recitation that the first feature is directly above and obliquely above the second feature, or simply indicate that the first feature is at a higher level than the second feature. The recitation that the first feature is "beneath," "below" and "under" a second feature may include the recitation that the first feature is directly below and obliquely below the second feature, or simply indicate that the first feature is at a lower level than the second feature.

In the description of the specification, reference to the description of "one embodiment," "some embodiments," "an example," "a specific example," or "some examples" or the like means that a particular feature, structure, material, or characteristic described in connection with the embodiment or example is included in at least one embodiment or example of the present disclosure. In this specification, the terminology used in the description presented above should not be understood as necessarily referring to the same embodiment or example. Furthermore, the particular features, structures, materials, or characteristics described may be combined in any suitable manner in any one or more embodiments or examples. Besides, various embodiments or examples described in this specification can be integrated and combined by one skilled in the art.

Heat-Not-Burn Naked Tobacco Products (Heated Tobacco Products)

The whole name of the heat-not-burn naked tobacco product is a heat-not-burn tobacco product, and the heat-not-burn naked tobacco product is also called a heated tobacco product. In the prior art, a heated cigarette is also a tobacco product, and tobacco is heated by using heat (different heating temperatures of different products) of about 300 to 350° C. in a non-burning mode. As the tobacco is not burnt, the tobacco of the heated cigarette can release nicotine and other chemical substances, but harmful substances in aerosol generated by using the heated cigarette are 90-95% less than harmful substances of smoke generated by burning a traditional cigarette, and meanwhile, no smoke or cigarette ash is generated.

Different from the traditional cigarette, the heated tobacco product cannot be directly ignited for burning and smoking, and only can be heated and smoked by a specific electronic device; and the electronic device for the heated cigarette cannot be used with the traditional cigarette, and must be used with a specific heated tobacco product. The heated cigarette contains nicotine like the traditional cigarette, can cause addiction, and can be used as a substitute for the cigarette by smokers.

The heat-not-burn tobacco product is a novel tobacco product combining a smoking set and a tobacco product, an electronic cigarette is generally designed by the heat-not-burn technology in the prior art, the heating temperature is within the range of 250-350° C., and processed tobacco shreds (tobacco products) are heated by a heating device (smoking set) to the circumstance that the tobacco shreds sufficiently emit fragrance and tobacco flavor, so that nicotine intake and smoke flavor required by consumers are provided.

Generally, when ordinary cigarettes are smoked, the temperature may reach more than 800° C. at most, and more than 200 harmful substances may be generated at the temperature of 370° C. to 600° C. By using the heat-not-burn tobacco product, most harmful substances are avoided from being produced under the condition of not burning at the temperature lower than 350° C. Compared with the traditional cigarette, the heat-not-burn tobacco product has the advantages of less nicotine, no tar, no cigarette ash, no open fire and no harm of second-hand smoke. From the structure, the structures of the heat-not-burn smoking sets are largely identical but with minor differences, and the structure of each heat-not-burn smoking set mainly includes three components including a battery, a main board and a heating rod/a heating sheet/a heating tobacco product.

The heated tobacco product is the most important chemical ingredient for the three main components of a heat-not-burn cigarette. The technical solution of the present disclosure is invented and created with regard to the core component of the heated tobacco product.

Specifically, an embodiment of the present disclosure provides an environment-friendly wrapping-free heat-not-burn naked tobacco product, including: 20-60% of mixed powder, 10-40% of a porous carrier material, 15-50% of a tobacco extraction mixture, 1-10% of a particle aggregation inhibitor and 10-40% of a binder by mass; wherein the mixed powder, the porous carrier material, the tobacco extraction mixture, the particle aggregation inhibitor and the binder are mixed in percentage by mass to prepare a stereoscopic porous naked tobacco product, and the formed stereoscopic porous naked tobacco product can be in an optional shape, and the shape of the stereoscopic porous naked tobacco product is suitable for being matched with a smoking cavity of the heating smoking set.

The mixed powder includes: 10-30% of tobacco leaves, 10-40% of tobacco stems and 20-60% of scented plants in percentage by mass. The tobacco leaves include: at least one of tobacco leaf upper portion powder, tobacco leaf middle portion powder and tobacco leaf lower portion powder. The scented plants include at least one of moxa stems, *Citrus aurantium* L. var. *amara* Engl., stems of notoginseng flowers, tea leaves, flos lonicerae, herba taraxaci, folium menthae, folium nelumbinis, coconut shells, flos plumeriae acutifoliae, herba mesonae chinensis, herb gynostemmae pentaphylli, herba laggerae, maca, antrodia camphorata, tea stems and fruit of solanaceous plants.

The tobacco extraction mixture includes: 10%-50% of a tobacco extract and 50%-90% of a food-grade alcohol solvent in percentage by mass.

The food-grade alcohol solvent includes: 1-20% of edible alcohol, 10-60% of glycerol and 1-60% of propylene glycol in percentage by mass.

In some embodiments, the concentration of the edible alcohol is 75 wt %.

In some embodiments, the particle aggregation inhibitor includes: one or a combination of glycerol triacrylate, glycerol trimethacrylate and pentaerythritol tetraacrylate.

The binder is at least one of polyvinylpyrrolidone, vinyl pyrrolidone-vinyl acetate copolymer, dextrin, starch, methyl cellulose, ethyl cellulose, CMC, CMCNa, guar gum, xanthan gum and HPMC.

The porous carrier material is an inorganic porous carrier material, and the inorganic porous carrier material is at least one of a molecular sieve, zeolite powder, macroporous resin, porous ceramic powder, alumina powder, coral powder, porous silica gel, oak powder, foamed nickel, foamed aluminum, porous stainless steel, porous silicon carbide and foamed glass.

The porous carrier material is an organic porous carrier material, and the organic porous carrier material is at least one of expanded tobacco stem powder, flower stem powder, radix puerariae powder, coffee powder and folium menthae powder.

The following preparation examples of the naked tobacco product proportioned specifically are carried out according to the proportion of components:

The environment-friendly wrapping-free heat-not-burn tobacco product provided by the present disclosure is described in detail below.

Example 1: An Environment-Friendly Wrapping-Free Heat-not-Burn Naked Tobacco Product and a Preparation Process The following components are proportioned by mass: 5 parts of tobacco leaf powder (composed of upper portion tobacco leaf powder, middle portion tobacco leaf powder and lower portion tobacco leaf powder according to the weight ratio of 1:3:1), 2 parts of tobacco stem powder, 1 part of tea leaf powder, 1 part of porous ceramic powder and 1 part of tobacco extraction mixture.

7 parts of tobacco leaves (composed of upper portion tobacco leaves, middle portion tobacco leaves and lower portion tobacco leaves according to the weight ratio of 1:3:1, or composed of at least one of the upper portion tobacco leaves, the middle portion tobacco leaves and the lower portion tobacco leaves), 2 parts of tobacco stems and 1 part of tea leaves were mixed uniformly to be used as a raw material of mixed powder; and the mixed plant raw materials were placed into a grinder to be pulverized, and the pulverized product was sieved by a 80-mesh sieve to obtain mixed powder for later use. Tobacco was then taken to be pulverized, heated, refluxed and extracted, the obtained extract was then subjected to fractional distillation via a molecular distillation apparatus, a rectified tobacco fragrance ingredient was collected to be used as a tobacco extract, 5 parts of the tobacco extract was taken, and was then added with 5 parts of a food-grade alcohol solvent (composed of 2 parts of 75% wt edible alcohol, 5 parts of glycerol and 3 parts of propylene glycol), and the tobacco extract and the food-grade alcohol solvent were mixed and stirred uniformly to prepare a tobacco extraction mixture for later use. 1 part of porous ceramic powder and 1 part of the tobacco extraction mixture were added into the mixed powder to obtain a mixture A; the mixture A was added with glycerol trimethacrylate which accounted for 1.2% of the weight of the mixture A and polyvidone K90 which accounted for 8% of the mixture A, and the mixed product was stirred uniformly, and extruded and formed. The extruded product was then cut into cylinders with the diameter of 1 mm-10 mm and the height of 1 mm-45 mm, meanwhile, irregular pores were formed in side faces of the cylinders, the cylinders were dried until the water content reached 14 wt %, the drying temperature was controlled within 60° C., and meanwhile, the drying time was controlled within 70 minutes.

Figure 2:
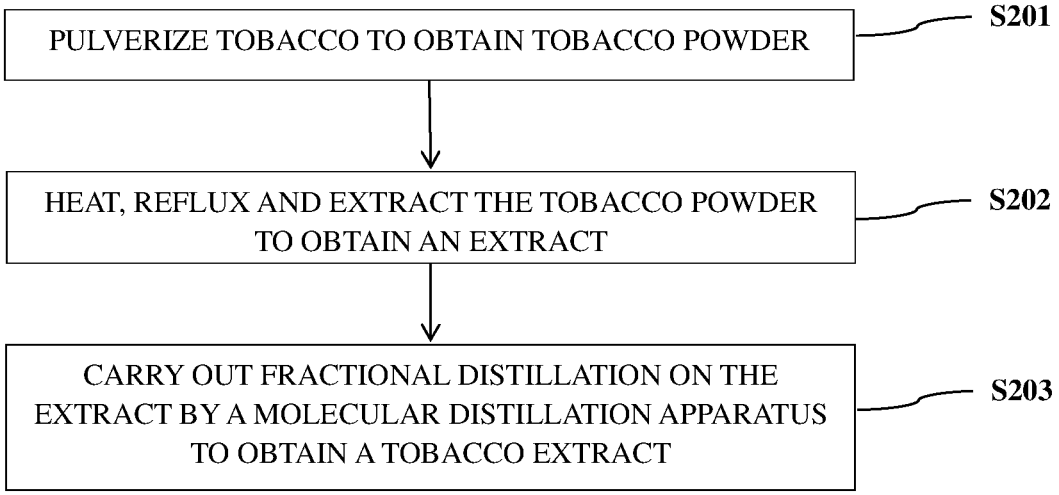
FIG. 2 is a secondary flow chart of the preparation method for the environment-friendly wrapping-free heat-not-burn naked tobacco product according to the present disclosure.

An embodiment of the present disclosure further discloses a preparation method for an environment-friendly wrapping-free heat-not-burn naked tobacco product, the preparation method is used for preparing any above-mentioned environment-friendly wrapping-free heat-not-burn naked tobacco product, and referring to FIG. 1 to FIG. 2, the preparation process includes the following steps:

step S100, mixed powder is prepared, tobacco leaves, tobacco stems and scented plants are selected according to a set mass ratio of components, and the tobacco leaves, the tobacco stems and the scented plants are ground and pulverized and then mixed to obtain the mixed powder;

step S200, a tobacco extraction mixture is prepared, and a tobacco extract and a food-grade alcohol solvent are mixed and stirred according to a set mass ratio of components to obtain the tobacco extraction mixture;

step S300, mixing and stirring are carried out, the tobacco extraction mixture and a porous carrier material are added into the mixed powder to be mixed and stirred uniformly to obtain a stirred mixture;

step S400, a naked tobacco product is formed, a particle aggregation inhibitor and a binder are added into the stirred mixture, the mixed product is fully stirred, and the stirred product is extruded into a stereoscopic porous naked tobacco product by means of an extruding machine; and step S500, drying treatment is carried out, the formed stereoscopic porous naked tobacco product is subjected to drying treatment to obtain the environment-friendly wrapping-free heat-not-burn naked tobacco product.

In the present disclosure, after the tobacco leaves, the tobacco stems and the scented plants are ground and pulverized, a step of sieving the pulverized product by a 80-mesh sieve is further carried out.

In the present disclosure, preparing the tobacco extract includes the following steps:

step S201, tobacco is pulverized to obtain tobacco powder;

step S202, the tobacco powder is heated, refluxed and extracted to obtain an extract; and step S203, the extract is subjected to fractional distillation via a molecular distillation apparatus to obtain the tobacco extract. The extruded stereoscopic porous naked tobacco product is cylindrical, rhombic, polygonal or spherical, and when the stereoscopic porous naked tobacco product is cylindrical, the stereoscopic porous naked tobacco product has the diameter of 1-10 mm and the height of 1-45 mm. In other embodiments, the tobacco product is optional in shape and also optional in size, and the shape and size of the tobacco product can be selected according to demands of users.

In the present disclosure, in the drying treatment step, the water content in the dried environment-friendly wrapping-free heat-not-burn naked tobacco product is 5-30%.

In the present disclosure, in the drying treatment step, the drying temperature does not exceed 60° C., and the drying time does not exceed 2 h.

Example 2: Another Environment-Friendly Wrapping-Free Heat-not-Burn Naked Tobacco Product and a Preparation Process The following components are proportioned by mass, and an environment-friendly heat-not-burn tobacco product includes 6 parts of tobacco leaf powder (composed of upper portion tobacco leaf powder, middle portion tobacco leaf powder and lower portion tobacco leaf powder according to the weight ratio of 1:3:1, or composed of at least one of the upper portion tobacco leaf powder, the middle portion tobacco leaf powder and the lower portion tobacco leaf powder), 1 part of tobacco stem powder, 1 part of powder of stems of notoginseng flowers, 1 part of macroporous resin and 1 part of a tobacco extraction mixture.

7 parts of tobacco leaves (composed of upper portion tobacco leaves, middle portion tobacco leaves and lower portion tobacco leaves according to the weight ratio of 1:3:1), 1 part of tobacco stems and 2 parts of stems of notoginseng flowers were mixed uniformly; and the mixed plant raw materials were placed into a grinder to be pulverized, and the pulverized product was sieved by a 80-mesh sieve to obtain mixed powder for later use. Tobacco was pulverized, heated, refluxed and extracted, the obtained extract was then subjected to fractional distillation via a molecular distillation apparatus, a rectified tobacco fragrance ingredient was collected as a tobacco extract, then 5 parts of the tobacco extract was taken, and was added with 9 parts of a food-grade alcohol solvent (composed of 1 part of 75 wt % edible alcohol, 6 parts of glycerol and 3 parts of propylene glycol), and the tobacco extract and the food-grade alcohol solvent were mixed and stirred uniformly to prepare a tobacco extraction mixture for later use. 6 parts of the mixed powder was added with 1 part of macroporous resin and 3 parts of the tobacco extraction mixture to obtain a mixture A; the mixture A was added with glycerol trimethacrylate which accounted for 1.5% of the weight of the mixture A and polyvidone K90 which accounted for 10% of the mixture A, the mixed product was stirred uniformly, and extruded and formed, the extruded product was then cut into cylindrical tobacco products with the diameter of 6.0+/−0.02 mm and the height of 15.0+/−0.02 mm, meanwhile, irregular pores are formed in side faces of the cylinders, the cylindrical tobacco products were dried until the water content reached 13 wt %, the drying temperature was controlled within 60° C., and meanwhile, the drying time was controlled within 70 minutes.

The preparation process is the same as the preparation process of example 1.

Example 3: Another Environment-Friendly Wrapping-Free Heat-not-Burn Naked Tobacco Product and a Preparation Process The following components are proportioned by mass, and an environment-friendly heat-not-burn tobacco product includes 5 parts of tobacco leaf powder (composed of upper portion tobacco leaf powder, middle portion tobacco leaf powder and lower portion tobacco leaf powder according to the weight ratio of 1:3:1), 1 part of tobacco stem powder, 1 part of powder of *Citrus aurantium* L. var. *amara* Engl., 2 parts of zeolite powder and 1 part of a tobacco extraction mixture.

5 parts of tobacco leaves (composed of upper portion tobacco leaves, middle portion tobacco leaves and lower portion tobacco leaves according to the weight ratio of 1:3:1, or composed of at least one of the upper portion tobacco leaves, the middle portion tobacco leaves and the lower portion tobacco leaves), 2 parts of tobacco stems and 3 parts of *Citrus aurantium* L. var. *amara* Engl. were mixed uniformly; and the mixed plant raw materials were placed into a grinder to be pulverized, and the pulverized product was sieved by a 80-mesh sieve to obtain mixed powder for later use. Tobacco was pulverized, heated, refluxed and extracted, the obtained extract was subjected to fractional distillation via a molecular distillation apparatus, a rectified tobacco fragrance ingredient was collected as a tobacco extract, then 4 parts of the tobacco extract was taken, and was added with 7 parts of a food-grade alcohol solvent (composed of 2 parts of 75% wt edible alcohol, 3 parts of glycerol and 5 parts of propylene glycol), and the mixed product was mixed and stirred uniformly to prepare a tobacco extraction mixture for later use. The mixed powder was added with 2 parts of zeolite powder and 1.44 parts of the tobacco extraction mixture to obtain a mixture A; the mixture A was added with glycerol trimethacrylate which accounted for 1.3% of the weight of the mixture A and polyvidone K90 which accounted for 8% of the weight of the mixture A, the mixed product was stirred uniformly, and extruded and formed into cylindrical tobacco products with the diameter of 7 mm+/−0.1 mm and the height of 25 mm+/−0.1 mm, the cylindrical tobacco products were dried until the water content reached 13 wt %, the drying temperature was controlled within 60° C., and meanwhile, the drying time was controlled within 120 minutes.

The preparation process is the same as the preparation process of example 1.

Example 4: Another Environment-Friendly Wrapping-Free Heat-not-Burn Naked Tobacco Product and a Preparation Process The following components are proportioned by mass, and an environment-friendly heat-not-burn tobacco product includes 6 parts of tobacco leaf powder (composed of upper portion tobacco leaf powder, middle portion tobacco leaf powder and lower portion tobacco leaf powder according to the weight ratio of 1:3:1), 1 part of tobacco stem powder, 1 part of herba laggerae powder, 1 part of alumina powder and 1 part of a tobacco extraction mixture.

6 parts of tobacco leaves (composed of upper portion tobacco leaves, middle portion tobacco leaves and lower portion tobacco leaves according to the weight ratio of 1:3:1), 2 parts of tobacco stems and 2 parts of herba laggerae were mixed uniformly; and the mixed plant raw materials were placed into a grinder to be pulverized, and the pulverized product was sieved by a 80-mesh sieve to obtain mixed powder for later use. Tobacco was pulverized, heated, refluxed and extracted, the obtained extract was subjected to fractional distillation via a molecular distillation apparatus, a rectified tobacco fragrance ingredient was collected as a tobacco extract, then 4 parts of the tobacco extract was taken, and was added with 6 parts of food-grade alcohol solvent (composed of 2 parts of 75% wt edible alcohol, 4 parts of glycerol and 4 parts of propylene glycol), and the mixed product was mixed and stirred uniformly to prepare a tobacco extraction mixture for later use. 8 parts of the mixed powder was added with 1 part of alumina powder and 1 part of the tobacco extraction mixture to prepare a mixture A; and the mixture A was added with pentaerythritol tetraacrylate which accounted for 1.3% of the weight of the mixture A and polyvidone K90 which accounted for 10% of the weight of the mixture A, the mixed product was stirred uniformly, and extruded and formed into cylindrical tobacco products with the diameter of 7 mm+/−0.1 mm and the height of 25 mm+/−0.1 mm, the cylindrical tobacco products were dried until the water content reached 14 wt %, the drying temperature was controlled within 60° C., and meanwhile, the drying time was controlled within 70 minutes.

The preparation process is the same as the preparation process of example 1.

Example 5: Sensory Evaluation for an Environment-Friendly Wrapping-Free Heat-not-Burn Naked Tobacco Product During Burning Table 1 shows test results of sensory evaluation when the environment-friendly wrapping-free heat-not-burn naked tobacco product in the example and a commercially available product are heated.

TABLE 1

| Sample | Smoke amount (5) | Fragrance (32) | Harmony (6) | Offensive smell (12) | irritation (20) | Remaining taste (25) | Total |
|---|---|---|---|---|---|---|---|
| Example 1 | 4 | 32 | 5 | 10 | 15 | 25 | 91 |
| Example 2 | 4 | 28 | 5 | 10 | 15 | 22 | 84 |
| Example 3 | 4 | 28 | 6 | 12 | 16 | 25 | 91 |
| Example 4 | 4 | 32 | 6 | 10 | 15 | 22 | 89 |
| Commercially available sample 1 | 3 | 24 | 4 | 8 | 15 | 20 | 74 |
| Commercially available sample 2 | 4 | 24 | 4 | 8 | 15 | 20 | 74 |

The evaluation results show that: the environment-friendly wrapping-free heat-not-burn naked tobacco product is sufficient in smoke amount, good in stability, prominent in unique fragrance and good in harmony, smoke is soft and fine, offensive firewood smell that is quite criticized is avoided, irritation is small, the remaining taste makes people comfortable, and the sensory experience is good.

Example 6: Sensory Evaluation and Smoke Ingredient Evaluation During Burning of an Environment-Friendly Wrapping-Free Heat-not-Burn Naked Tobacco Product After the tobacco product is burned or heated, smoke is discharged. The smoke contains a large amount of chemical substances which can be mixed with harmful particles or organic substances and can cause harm to the environment and people around the smoke. In the present disclosure, the effect of reducing the content of harmful substances in the discharged smoke is achieved by adding the particle aggregation inhibitor into the tobacco product. The effect of restraining harmful substances in the discharged smoke of example 1 to example 4 and commercially available tobacco products is evaluated.

The principle of an evaluation method is to evaluate by analyzing ingredients of the smoke generated when the tobacco product is heated. The used method is a gas chromatography-mass spectrometry (GC/MS) method for ingredients of the smoke of a cigarette. The smoke is formed, and particles are gathered to form visible smoke to be displayed. Main ingredients of the tested particles include:

- amino-containing compounds (namely N-cyclo compounds), such as nitrosamines, arylamines and heterocyclic amines, and primarily carcinogens;
- alkanes and hydrocarbons, which are also carcinogens;
- other free radicals, which accelerate the oxidation reaction of a human body and destroy the functions of the human body after being inhaled into the human body;
- heavy metal particles, such as lead, which destroy the functions of the human body; and
- other components, such as carbon monoxide, nitrogen oxides and sulfur-containing gases, which are harmful to both air and the human body.

Existing burnable incense standards mainly include GB 26386-2011 *General Technical Conditions for Safety of Burnable Incense Products* and GB/T26393-2011 *Testing Methods for Harmful Substances of Burnable Incense Products.*

Chromatographic conditions: chromatographic column: Rxi-1 ms quartz capillary column (30 m×0.25 mm×0.25 μm); temperature rising procedure: maintaining at 50° C. for 0 min, heating to 150° C. at 10° C./min and maintaining for 3 min, heating to 280° C. at 7° C./min, and maintaining for 10 min; column flow rate: 1.0 mL/min; and sampling mode: carrying out split sampling, wherein the split ratio is 5:1.

A method for collecting burnable incense smoke in a simulated actual environment includes that a sampling point is arranged in a 1.8 m×1.8 m×1.8 m sealed glass square box according to the test condition of part 7 in a standard GB/T26393-2011 *Testing Methods for Harmful Substances of Burnable Incense Products*, and the collection is completed within 40 min; three sampling points away from one another by different distances are arranged in a 1.8 m×1.8 m×1.8 m sealed glass square box by taking the center as the origin point for collection, wherein the three sampling points are respectively a central point, a farthest point and a radius point. The result shows that the detection results of different sampling points have little difference, and the detection data of the central point is more stable. Therefore, in the present disclosure, the central point is selected as the sampling point. After smoke samples of the examples and the comparative examples are collected, the smoke samples are carried into a chromatographic column by an inert gas (namely carrier gas) and adsorbed. The final results (main chemical components) of the tests are shown in table 2 below.

TABLE 2

| Smoke ingredients | Aromatic hydrocarbons μg/m³ | Amines μg/m³ | Hetero-cycles μg/m³ | Heavy metal μg/m³ | $NO_x$ μg/m³ | $SO_x$ μg/m³ |
|---|---|---|---|---|---|---|
| Example 1 | 0.348 | 0.065 | 0.261 | 0.021 | 1.056 | 0.803 |
| Example 2 | 0.256 | 0.047 | 0.192 | 0.015 | 0.776 | 0.590 |
| Example 3 | 0.232 | 0.043 | 0.174 | 0.014 | 0.704 | 0.535 |
| Example 4 | 0.277 | 0.051 | 0.207 | 0.017 | 0.839 | 0.638 |
| Commercially available sample 1 | 0.460 | 0.077 | 0.345 | 0.025 | 1.396 | 0.996 |
| Commercially available sample 2 | 0.588 | 0.109 | 0.441 | 0.035 | 1.784 | 1.356 |

Table 2 shows the results of the composition analysis of the smoke generated by heating the tobacco product. Tests show that compared with a heated commercially available tobacco product, the tobacco product in the present disclosure has the characteristics that the content of irritant harmful substances such as aromatic hydrocarbon, amines, heavy metal and oxide in the smoke discharged from the tobacco product in the present disclosure is reduced by 20%.

Compared with the prior art, the environment-friendly wrapping-free heat-not-burn naked tobacco product provided by the present disclosure has the advantages that in order to prevent harmful substances from aggregating and volatilizing, a particle inhibitor is added into the ingredients for adjustment, so that the content of the harmful substances contained in smoke can be effectively controlled; meanwhile, the tobacco product does not need a paper tube, a filter tip and a blocking piece which are required for a traditional cigarette, and a naked tobacco product is utilized, so that the difficulty of the production process is reduced, raw materials are reduced, and the tobacco product is more environment-friendly. According to the naked tobacco product with the proportion of components, the smoke amount is abundant, the fragrance is good, smoke is soft and fine, offensive firewood smell is avoided, irritation is small, the remaining taste makes people comfortable, and the user experience is better.

Compared with the prior art, the environment-friendly wrapping-free heat-not-burn naked tobacco product in the present disclosure has the advantages that a main body, a sealing cover lining and a closing piece are utilized to jointly form a leather shell with better supporting effect, and meanwhile, the main body, the sealing cover lining and the closing piece can be processed in a standardized way, so that the purpose of large-scale industrial mass production is achieved.

The foregoing is only preferred embodiments of the present disclosure, and it should be noted that, for those skilled in the art, various modifications and amendments can be made without departing from the principle of the present disclosure, and these modifications and amendments should also be considered as the scope of protection of the present disclosure.

What is claimed is:

1. An environment-friendly wrapping-free heat-not-burn naked tobacco product, comprising: 20-60% of mixed powder, 10-40% of a porous carrier material, 15-50% of a tobacco extraction mixture, 1-10% of a particle aggregation inhibitor and 10-40% of a binder in percentage by mass;

wherein the mixed powder, the porous carrier material, the tobacco extraction mixture, the particle aggregation inhibitor and the binder are mixed in percentage by mass to prepare a porous naked tobacco product;

the mixed powder comprises: 10-30% of tobacco leaves, 10-40% of tobacco stems and 20-60% of scented plants in percentage by mass; and the particle aggregation inhibitor is selected from the group consisting of glycerol triacrylate and glycerol trimethacrylate.

2. The environment-friendly wrapping-free heat-not-burn naked tobacco product according to claim 1, wherein the tobacco leaves comprise: at least one of tobacco leaf upper portion powder, tobacco leaf middle portion powder and tobacco leaf lower portion powder.

3. The environment-friendly wrapping-free heat-not-burn naked tobacco product according to claim 2, wherein the scented plants comprise at least one of moxa stems, *Citrus aurantium* L. var. *amara* Engl., stems of notoginseng flowers, tea leaves, flos lonicerae, herba taraxaci, folium menthae, folium nelumbinis, coconut shells, flos plumeriae acutifoliae, herba mesonae chinensis, herb gynostemmae pentaphylli, herba laggerae, maca, antrodia camphorata, tea stems and fruit of solanaceous plants.

4. The environment-friendly wrapping-free heat-not-burn naked tobacco product according to claim 1, wherein the tobacco extraction mixture comprises: 10%-50% of a tobacco extract and 50%-90% of a food-grade alcohol solvent in percentage by mass.

5. The environment-friendly wrapping-free heat-not-burn naked tobacco product according to claim 4, wherein the food-grade alcohol solvent comprises: 1-20% of edible alcohol, 10-60% of glycerol and 1-60% of propylene glycol in percentage by mass.

6. The environment-friendly wrapping-free heat-not-burn naked tobacco product according to claim 1, wherein the binder is at least one of polyvinylpyrrolidone, vinyl pyrrolidone-vinyl acetate copolymer, dextrin, starch, methyl cellulose, ethyl cellulose, CMC, CMCNa, guar gum, xanthan gum and HPMC.

7. The environment-friendly wrapping-free heat-not-burn naked tobacco product according to claim 1, wherein the porous carrier material is an inorganic porous carrier material, and the inorganic porous carrier material is at least one of a molecular sieve, zeolite powder, macroporous resin, porous ceramic powder, alumina powder, coral powder, porous silica gel, oak powder, foamed nickel, foamed aluminum, porous stainless steel, porous silicon carbide and foamed glass.

8. The environment-friendly wrapping-free heat-not-burn naked tobacco product according to claim 1, wherein the porous carrier material is an organic porous carrier material, and the organic porous carrier material is at least one of expanded tobacco stem powder, flower stem powder, radix puerariae powder, coffee powder and folium menthae powder.

9. A method of preventing production of particle aggregate during heating of tobacco, comprising adding a particle aggregation inhibitor for regulating aggregation of active group particles through radical capture into a tobacco product, wherein the particle aggregation inhibitor is selected from the group consisting of glycerol triacrylate and glycerol trimethacrylate.

10. The method of claim 9, wherein the tobacco product is a heat-not-burn naked tobacco product.

11. The method of claim 9, wherein the particle aggregation inhibitor is added in an amount of 1-10% in percentage by mass.

* * * * *